US007174835B1

(12) United States Patent
Knapp

(10) Patent No.: US 7,174,835 B1
(45) Date of Patent: Feb. 13, 2007

(54) COVERT TRACER ROUND

(75) Inventor: David James Knapp, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/075,146

(22) Filed: Mar. 8, 2005

Related U.S. Application Data

(62) Division of application No. 10/241,669, filed on Sep. 11, 2002, now Pat. No. 6,880,467.

(51) Int. Cl.
*F41G 3/00* (2006.01)
*F41G 1/00* (2006.01)

(52) U.S. Cl. ..... 102/513; 102/501; 102/473; 102/293; 102/458; 89/41.06; 89/41.17; 89/1.1; 244/3.1

(58) Field of Classification Search ..... 102/513, 102/501, 473, 293, 458; 89/41.06, 41.17, 89/1.11, 1.1; 244/3.1
See application file for complete search history.

(56) References Cited

U.S. PATENT DOCUMENTS

| | | | | | |
|---|---|---|---|---|---|
| 2,458,448 | A | | 1/1949 | Tuttle | 89/41 |
| 3,598,344 | A | * | 8/1971 | Walters et al. | 244/3.11 |
| 3,623,045 | A | * | 11/1971 | Ouellette | 340/870.07 |
| 3,741,111 | A | * | 6/1973 | Brenner | 102/213 |
| 3,757,632 | A | | 9/1973 | Bellinger | 89/1 |
| 3,954,228 | A | | 5/1976 | Davis, Jr. | 244/3.16 |
| 3,962,537 | A | * | 6/1976 | Kearns et al. | 348/144 |
| 4,015,258 | A | | 3/1977 | Smith et al. | 343/6 |
| 4,040,744 | A | | 8/1977 | Schertz et al. | 356/152 |
| 4,202,246 | A | | 5/1980 | Schertz et al. | 89/41 |
| 4,245,560 | A | * | 1/1981 | Rambauske | 102/213 |
| 4,934,273 | A | * | 6/1990 | Endriz | 102/336 |
| 5,018,447 | A | * | 5/1991 | Miller et al. | 102/213 |
| 5,208,417 | A | | 5/1993 | Langer et al. | 89/41.06 |
| 5,359,920 | A | | 11/1994 | Muirhead et al. | 89/41.07 |
| 5,456,157 | A | | 10/1995 | Lougheed et al. | 89/134 |

(Continued)

FOREIGN PATENT DOCUMENTS

| | | |
|---|---|---|
| GB | 1 455 119 | 11/1976 |

(Continued)

OTHER PUBLICATIONS

International Search Report for International Application No. PCT/US03/28617.

*Primary Examiner*—James S. Bergin
(74) *Attorney, Agent, or Firm*—Renner, Otto, Boisselle & Sklar, LLP

(57) ABSTRACT

A covert tracer round has an infrared emitter of radiation mounted to its front, side or back. The radiation (which may be coherent or incoherent) is detected by a sensor that displays an image of the target and the beam. The sensor receives the beam directly if the emitter is on the back of the round and by reflection off the target or nearby objects if the emitter faces forward. The round may include a fixed or moveable collimating lens. The emitter may radiate radially from the round to signal troops or devices located along its path. The round may include sensors that gather significant information about chemicals or biological agents, about magnetic or gravitational anomalies or any other remotely detectable property and transmit that information to the sensor by modulating the emitted radiation.

8 Claims, 2 Drawing Sheets

U.S. PATENT DOCUMENTS

| | | | | |
|---|---|---|---|---|
| 5,478,028 | A * | 12/1995 | Snyder | 244/3.11 |
| 5,596,509 | A | 1/1997 | Karr | 364/516 |
| 5,686,690 | A | 11/1997 | Lougheed et al. | 89/41.17 |
| 5,848,763 | A * | 12/1998 | Mitchell et al. | 244/3.11 |
| 6,038,955 | A | 3/2000 | Thiesen et al. | 89/41.17 |
| 6,260,792 | B1 | 7/2001 | Zwirn et al. | 244/3.11 |
| 6,467,722 | B1 * | 10/2002 | Berry et al. | 244/3.21 |
| 2005/0034627 | A1 * | 2/2005 | Manole et al. | 102/513 |

FOREIGN PATENT DOCUMENTS

| | | |
|---|---|---|
| GB | 1 587 698 | 4/1981 |
| GB | 2 107 835 | 5/1983 |
| GB | 2 173 393 | 10/1986 |

* cited by examiner

COVERT TRACER ROUND

RELATED APPLICATION

This application is a divisional of, and claims priority under 35 U.S.C. § 120 to, commonly-assigned U.S. application Ser. No. 10/241,669 which was filed on Sep. 11, 2002 now U.S. Pat. No. 6,880,467. The entire disclosure of this earlier application is hereby incorporated by reference.

FIELD OF THE INVENTION

The present invention relates to tracer rounds used by gunners to follow the trajectory of rounds as they are fired so as to aid the aim of subsequent rounds.

BACKGROUND OF THE INVENTION

Tracer rounds are used to help gunners follow the rounds shot to correct their aim when the rounds fall wide of their intended targets. Conventional tracer rounds give off a bright pyrotechnic light along the path from muzzle to impact. This has the unfortunate side effect of pointing directly at the gunner, making it easier for opposing forces to locate the source of fire.

Some guns today are equipped with laser sights. These lasers project a dot on the target to help the gunner aim. However, the laser beam does not follow the arc of a round, and so the distance to the target must be taken into account in aiming the weapon. Higher-powered lasers have been used in both collimated and diverging configurations to create spotlights on targets. Both visible and infrared radiation has been used. These lasers are typically mounted on the shooting platform or on a cooperative platform. These systems present difficulties including the risk of eye damage to those on or near the platform and also raise electro optical signature concerns. Reflectors have been mounted on the rear end of rounds to reflect laser radiation from a laser that is guided to follow the path of the round. These devices allow the round to reflect radiation back to the gunner. All of the techniques noted above have disadvantages of one sort or another.

SUMMARY OF THE INVENTION

The present invention teaches how to make and use a tracer round that includes a device for emitting radiation mounted to it. The radiation may be coherent or incoherent, aimed forward to reflect off the target and then be detected, or rearward to be detected directly.

If coherent, the radiation may be emitted by a laser diode emitting in the infrared band from about 650 nanometers to about 850 nanaometers or longer wavelengths. The round therefore is visible to a gunner wearing night vision goggles, but not visible to the naked eye. If the diode emits in the band to which GEN III Extended Response detection systems are responsive, then only those with this special equipment will be able to see and follow the tracer.

The diode may be mounted in the front of the round with a lens to produce a collimated forward looking beam. The beam illuminates the target, and the reflected signal is detected, providing real-time input on the approach of the round to the target based on the size and position of the reflected beam.

The diode may also be mounted to the rear of the round with collimating optics. For rear facing diodes timers may be used to increase the diode's output to compensate for the increasing distance from the gun. With appropriate collimation, the gunner is the only one likely to see the tracer round's emission.

If incoherent radiation is used, the source may be an LED or a conventional filament. Filters may be used to select a desired band of wavelengths if a broad band source such as a filament is used.

The emitted radiation may also be used for signaling. For example, the round may include a sensor for chemical or biological weapons, and a circuit responsive to the sensor may modulate the laser emissions, encoding data concerning the presence of chemical agents. Other uses of the round-mounted radiation emitter are possible, including uses that involve having the emitted beam aimed radially. Such a beam may signal troops or devices along the path of the round. The tracer round may also be used to guide other ordinance to the target by following the emitted beam of radiation.

The emitted radiation may also be used as a decoy. It may be used to emulate emissions from other types of munitions, thereby to confuse the target about the type of attack it is suffering.

In addition to infrared emitters, the round may have a visible or an ultraviolet emitter, or a combination. The round could be used for emitting in the visible spectrum during daylight and be switched to infrared at night. The emitter may be actuated by a timer, or the round may include a receiver, such as a radio frequency receiver, that activates the emitter or that causes it to switch between e.g., visible and infrared emitters.

DESCRIPTION OF EMBODIMENTS OF THE PRESENT INVENTION

Figure 1:
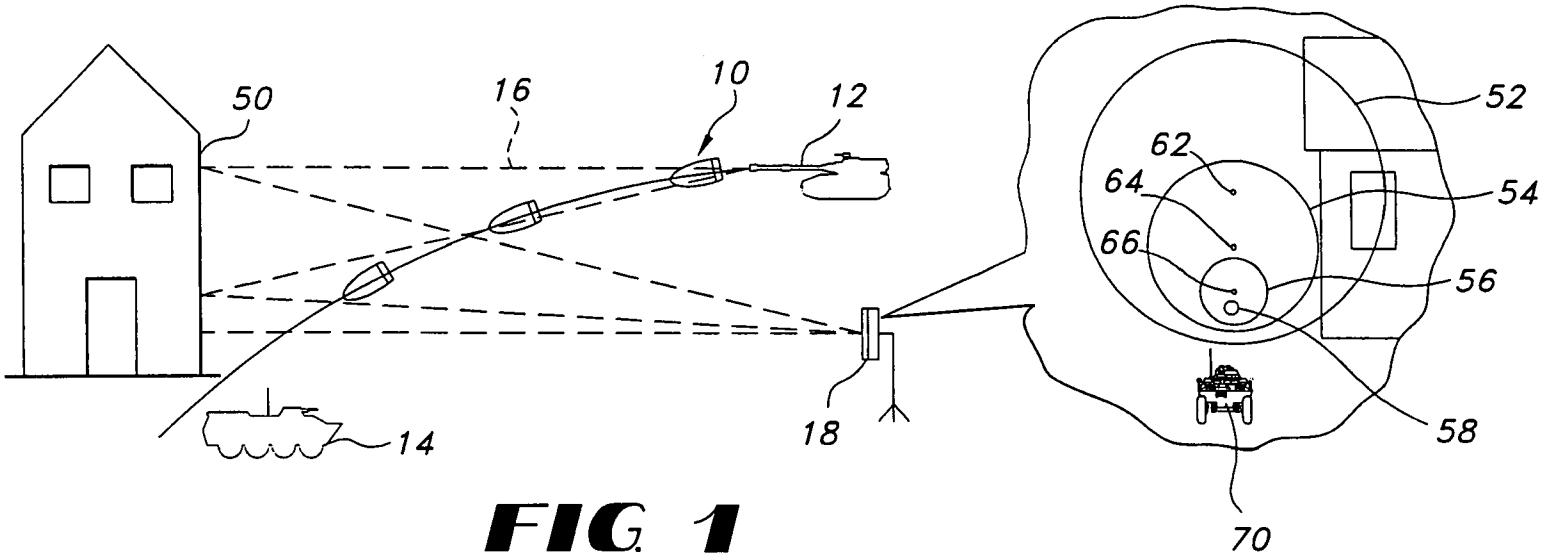
FIG. 1 is a schematic illustration of a gun that has just fired a tracer round, and it shows a beam of reflected coherent radiation emitted by the tracer round received by a sensor device at three different positions of the round.

FIG. 1 schematically illustrates a tracer round 10 built following the teachings of the present invention. A gun 12 is shown having just fired the tracer round 10, and the round is shown in three successive positions as it travels toward (but misses) a target 14. A beam of coherent radiation 16 emitted by the tracer round 10 illuminates the target 14 and surrounding structures and is reflected to a receiver 18 so that the gunner may correct the aim point of the gun 12 for subsequent rounds.

The receiver 18 is shown as a separate antenna, but it is readily apparent that the receiver could as well be night vision goggles worn by the gunner or could be mounted to the same equipment or carriage to which the gun itself is mounted.

Figure 2:
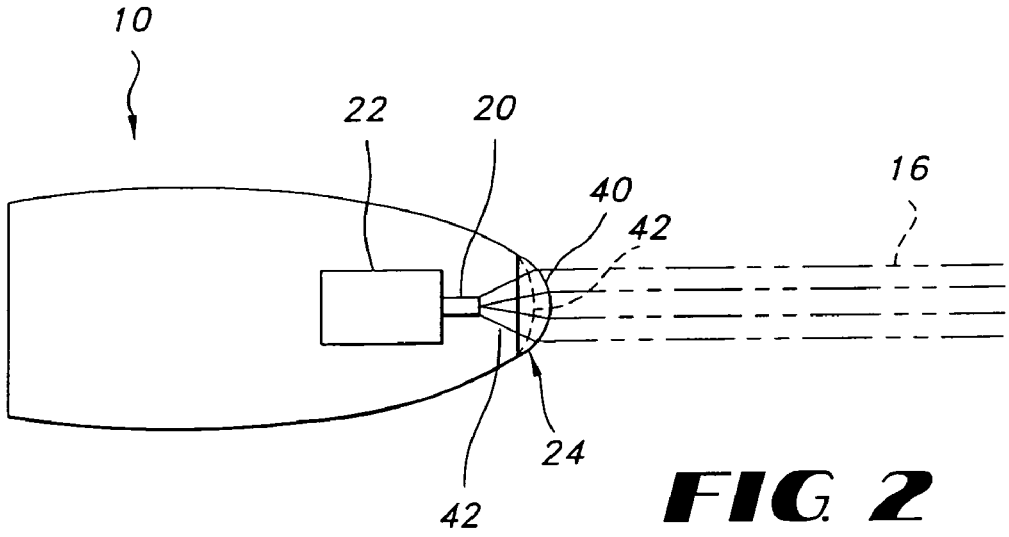
FIG. 2 illustrates a tracer round with a forward projecting diode and a collimating lens together with an electronics and power supply package.

The tracer round 10 is illustrated schematically in FIG. 2. The round 10 includes a device 20 for emitting coherent electromagnetic radiation (a laser diode or similar device), an electronics and power supply package 22, and a lens or collimator 24 at the nose of the round. When the package 22 is activated, the laser 20 emits coherent radiation which is focused into a narrow beam 16 by the collimator 24. This beam 16 projects straight forward from the tracer round 10, diverging in a predictable way as the distance from the round increases.

Figure 3:
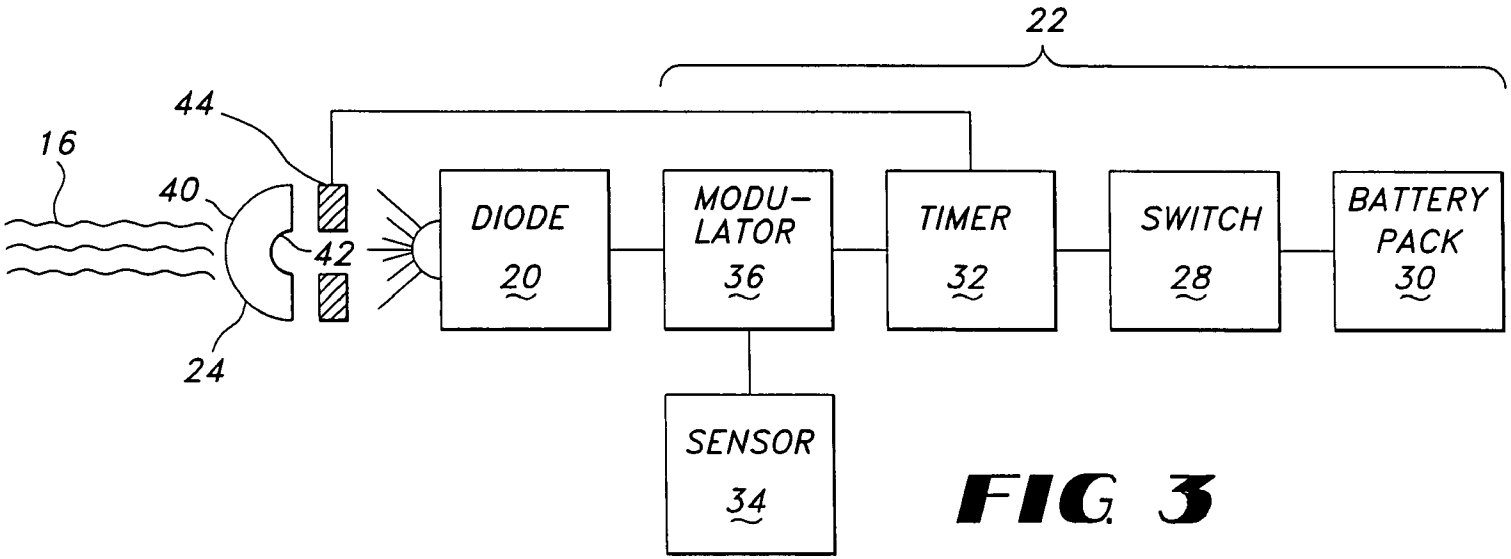
FIG. 3 is a schematic illustration of the electric/electronic components of the tracer round of FIG. 2.

The electronics and power supply package 22 includes a switch 28 (FIG. 3) to activate the power to the laser diode 20. An accelerometer or equivalent acceleration sensitive switch may be used to turn the laser diode 20 on so that the circuitry is activated by the force driving the round 10 out of the gun. Alternatively, the activating switch 28 could be temperature sensitive, responsive to the sudden rise in temperature which accompanies firing the tracer round 10 out of the gun 12. Power is supplied by a conventional battery pack 30 or any other source of electric energy. The battery pack 30 should have good shelf life and be able to produce a relatively large power output for the brief time it takes the round 10 to reach its intended target.

The electronics package 22 may also perform additional functions. The circuitry may include a timer 32 that delays turning on the diode 20 until a predetermined time after it leaves the gun 12 to conserve electric power. This may also help prevent detection of the gun's location by hostile forces. The circuitry 22 may also cause the laser diode's output of coherent radiation to be pulsed to allow the receiver to be range gated. In such a system, the receiving circuitry is receptive only during the brief time intervals when the signal should be received if it is reflected off of the putative target. Signals reflected off of intervening objects therefore are rejected.

The electronics package 22 may also modulate the coherent radiation for other purposes. For example, the tracer round could be equipped with a chemical or biological warfare agent sensor 34. When the sensor detects a target chemical, the laser signal is modulated by modulator 36 in a predetermined manner. The circuitry associated with the signal receiving apparatus would then present the gunner with information about the chemical hazards to be found down range. Other sensors, such as those detecting gravitational or magnetic anomalies could also be used, for example, to detect metal objects or high or low density locations along the path of the tracer round.

The laser diode 20 may emit its coherent radiation in the near infra-red spectrum. Specifically the laser diode 20 may emit in the conventional Gen III band, or it may emit at the Gen III ER (extended response) band. If the tracer is to be used during daylight, it may be provided with a visible light emitting laser diode. Use of a Gen III ER diode greatly reduces the chance that hostile forces will be able to follow the flight of the tracer back to its origin because equipment to detect radiation of that band is not widely available.

The laser diode 20 (FIG. 2) is mounted behind a collimating lens 24. The lens is located at the nose of the tracer round 10 and provides an aerodynamically smooth outside surface 40. The inside surface 42 of the lens 24 is curved so that, in combination with the outside surface, the laser light from the laser diode 20 forms a tightly focused beam 16. Such a beam diverges with distance traveled in a known way. Accordingly, the size of the spot received at the sensor 18 (FIG. 1) is a direct measure of the distance the beam has traveled and so of the distance to the target 14.

The lens 24 may be mounted with a means 44 (FIG. 3) to adjust the focus of the beam during the flight of the tracer round. Such means 44 include piezoelectric devices and/or heat sensitive materials that will shift the lens position as its temperature changes or as an electric current is applied. Regardless of the means used, the degree of collimation can be varied over the path of the tracer round 10. If this is done, adjustments must be made in the distance calculation to compensate for the changing size of the beam as it leaves the lens. When the tracer round 10 (FIG. 1) is fired from a gun 12, its laser beam 16 illuminates the target 14 or objects 50 near the target, and some of that beam is reflected backward to the gunner. As illustrated in FIG. 1 the reflected beam at first is large 52 and with relatively a low intensity. As the tracer round 10 approaches the target 14, the reflected image shrinks and grows more intense (all other things being equal) as illustrated by images 54 and 56. The reflected image also lowers in position because of the effect of gravity on the tracer round 10.

The receiver 18 includes circuitry to process the reflected image. As noted above, the absolute size of the image is a direct measure of the path length of the beam from the round to the target or other point of reflection and back to the receiver 18. This initial reflected image as received by the receiver 18 is illustrated by the outer circle 52 in FIG. 1. As the round 10 approaches the target 70 the path length of the beam 16 shortens, and accordingly the reflected image at the sensor gets smaller. Circles 54 and 56 represent the images received at the receiver 18 at intermediate positions of the tracer round as it approaches the target. The innermost circle 58 in FIG. 1 represents the reflected image received at the receiver 18 in the last moment before the round hits (or misses, as illustrated in FIG. 1) the target 14. FIG. 1 also illustrates how the centers 62, 64 and 66, respectively, of the reflected beams move downward as the tracer round 10 is pulled down by gravity. If the receiver 18 is also provided with an image 70 representing the target 14, then the gunner can correct his aim before firing subsequent rounds to achieve the desired effect.

Figure 4:
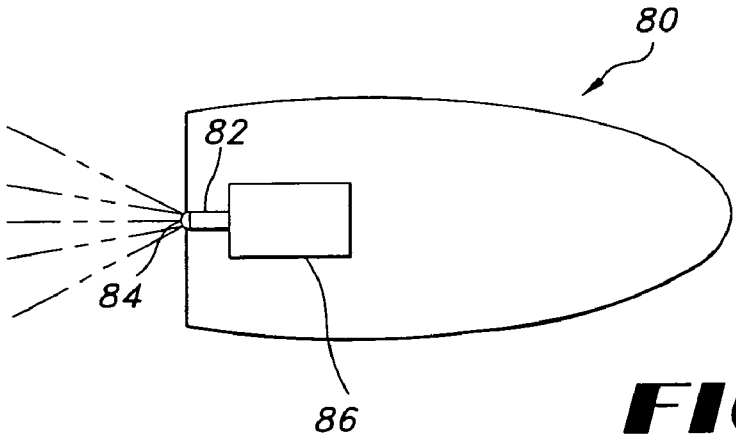
FIG. 4 illustrates a tracer round with a backward projecting diode and collimating lens.

FIG. 4 illustrates another tracer round 80 using the teachings of the present invention. Here the laser diode 82, lens 84, and electronics package 86 are located at the rear of the round 80 and are rear facing. With the tracer round 80 the gunner is able to view directly the laser radiation 88 rather than viewing a beam reflected from the target.

The tracer round 80 may be provided with an electronics package 86 that, in addition to having all the functions of the circuitry in the electronics and power supply package 22, also increases the power of the beam 88 as the time from firing increases. This may be done stepwise, providing live data that can be combined with a velocity v. distance profile of the round to provide real-time information about the round's position and distance to the target. This may prove useful if the round is equipped with other sensors 34 such as chemical or biological agent detectors, the output of which can then include precise information about the location of suspect chemicals.

The tracer round 80 may also be provided with a variable zoom lens similar in function to that described in connection with tracer round 10. With the rear facing laser diode 82, the perceived intensity of the beam decreases and size of the "spot" increases as the round moves away from the gunner. A lens 84 that has the effect of tightening the beam 88 as the round 80 moves away may prove advantageous. As noted, this can be accomplished either with a piezoelectric lens mounting or by mounting the lens with a material that contracts as it cools, the contraction moving the lens. The tighter the beam 88 the more covert the tracer round becomes since a tight beam makes it less likely that others than the gunner will detect direct (as opposed to reflected) infrared radiation from the round. Either the forward facing arrangement of FIG. 2 or the rear facing arrangement of FIG. 4 can also be used to guide other ordinance that is capable of following the laser signals generated by the rounds 10 and 80.

Figure 5:
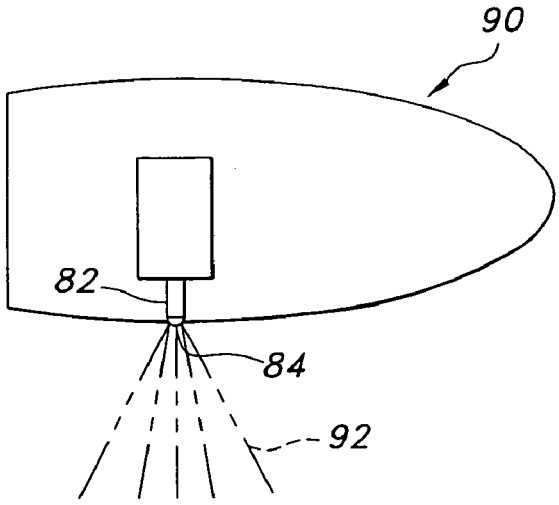
FIG. 5 illustrates a round with a laser positioned to emit coherent radiation radially of the path of the round.

A tracer round 90 (FIG. 5) may also be made using the teachings of the present invention in which the beam 92 is directed radially of the round. Such an arrangement could be used as a signal to troops or devices along the path of the round. For example troops could be signaled to advance or retreat upon firing of the round by its emission of a modulated, coded infrared signal as it passes overhead. Such a round could also act as a trigger for a previously planted explosive device.

The tracer rounds described above may have a visible or ultraviolet emitter, and any of the emitters may emit coherent or incoherent radiation. The rounds may be provided with two or more emitters of different wavelengths. In such a case the switch 28 may be used to select between the two emitters. This may prove useful if a visible emitter is used during the daylight hours and an infrared emitter is used after dark.

The switch 28 may also include a receiver, such as a radio frequency receiver to actuate it. In this case a tracer round may be fired and the emitter, e.g. diode 20, remains inoperative until a signal is received to activate the emitter. Equipped in this way, the tracer round could be fired by ground troops and activated by a transmitter on an airplane or helicopter that has been called in to support the troops.

Finally, it should be noted that the tracer rounds described are not pyrotechnic. Accordingly, they are less likely to start a fire when they hit (or miss) their target. This could prove advantageous when the military goal is to capture rather than destroy a target or in urban settings where civilian casualties are to be avoided.

Although devices that are constructed following the teachings of the invention have been described, the teachings may be used as well to construct other devices that are within the scope of the invention. Accordingly, the invention is not to be viewed as limited to the specific embodiment described, but instead is limited only by the claims that follow.

What is claimed is:

1. A tracer round including a projectile to be fired from a gun, a supply of electric power, a radiation emitter connected to the supply of electric power, a lens, mounted to the projectile, to focus the radiation emitted by the emitter, and means for adjusting the lens during flight, and a switch to connect the supply of electric power to the emitter; wherein the switch is activated by heat or is activated by acceleration of the tracer round.

2. The tracer round of claim 1, wherein the emitter emits in the infrared spectrum.

3. The tracer round of claim 1, wherein the emitter emits in the visible spectrum.

4. The tracer round of claim 1, wherein the emitter emits in the ultraviolet spectrum.

5. A tracer round including:

a projectile to be fired from a gun, a supply of electric power, a radiation emitter connected to the supply of electric power, and a lens, mounted to the projectile, to focus the radiation emitted by the emitter, means for adjusting the lens during flight;

wherein the emitter connected to the supply of power is a first emitter and further including a second emitter, connected to the power supply and a switch for selectively connecting one or the other of the first and second emitters to the power supply.

6. A tracer round including a projectile to be fired from a gun, a supply of electric power, a source of radiation connected to the power supply when the projectile is fired from the gun for emitting detectable radiation, and a lens movably mounted with respect to the source of radiation to adjust the spread of the beam during the flight of the tracer round; wherein the radiation is coherent, and wherein the coherent radiation is modulated in response to signal generated by a remote sensing device included in the tracer round.

7. The round of claim 6 wherein the radiation is emitted in the same direction as the round travels.

8. The round of claim 6 wherein the radiation is emitted in the opposite direction from the direction of travel of the round.

* * * * *